US005773922A

United States Patent [19]

Lee et al.

[11] Patent Number: 5,773,922

[45] Date of Patent: Jun. 30, 1998

[54] DIRECT HEATING CATHODE AND PROCESS FOR PRODUCING SUCH

[75] Inventors: Kwang-Min Lee; Kyu-Nam Joo; Jong-Seo Choi; Geun-Bae Kim; Kwi-Seuk Choi, all of Suwon, Rep. of Korea

[73] Assignee: Samsung Display Devices, Co., Ltd., Kyungki-do, Rep. of Korea

[21] Appl. No.: 565,545

[22] Filed: Nov. 30, 1995

[30] Foreign Application Priority Data

Dec. 28, 1994 [KR] Rep. of Korea ..... 94 38126

[51] Int. Cl.[6] ..... H01J 1/18; H01J 9/04

[52] U.S. Cl. ..... 313/346 R; 445/51

[58] Field of Search ..... 445/50, 51; 313/346 R, 313/346 DC

[56] References Cited

U.S. PATENT DOCUMENTS

| | | | |
|---|---|---|---|
| 1,689,338 | 10/1928 | Harris . | |
| 3,766,423 | 10/1973 | Menelly | 313/346 R |
| 3,877,930 | 4/1975 | Volin . | |
| 4,417,173 | 11/1983 | Tuck et al. | 313/346 R |
| 5,407,633 | 4/1995 | Hasker et al. | 419/19 |
| 5,580,291 | 12/1996 | Redel et al. | 445/51 X |

FOREIGN PATENT DOCUMENTS

| | | |
|---|---|---|
| 0143222 | 9/1984 | European Pat. Off. . |
| 1 460 373 | 12/1965 | France . |
| 4026298 A1 | 8/1990 | Germany . |
| 1591789 | 7/1976 | United Kingdom . |

*Primary Examiner*—Kenneth J. Ramsey
*Attorney, Agent, or Firm*—Lowe Hauptman Gopstein & Berner

[57] ABSTRACT

A direct heating cathode for electron guns and a process for producing such a cathode are disclosed. The above direct heating cathode achieves a high current density, extends the expected life span and simplifies the cathode producing process. In the process for producing the above cathode, powdered iridium (Ir) as a basic ingredient is mixed with powdered cerium (Ce) as a subsidiary ingredient at a given mixing ratio into a powdered metal mixture. The powdered metal mixture in turn is applied with a mechanical impact through high energy ball milling, thereby being mechanically alloyed into alloy powder. The alloy powder is compressed with a given pressure, thereby being formed into an alloy pellet. The alloy pellet in turn is heated to remove residual gases from the pellet. Thereafter, the electron emitting performance of the pellet is tested.

6 Claims, 2 Drawing Sheets

DIRECT HEATING CATHODE AND PROCESS FOR PRODUCING SUCH

BACKGROUND OF THE INVENTION

1. Field of the Invention

The present invention relates in general to direct heating cathodes suitable to be used in three electron guns installed in a color picture tube and to a process for producing such direct heating cathodes. Particularly, the present invention relates to a serial cathode of a metal alloy and to a process for producing such a cathode, the metal alloy direct heating cathode achieving a high current density, an extended life span and a simplified cathode producing process.

2. Description of the Prior Art

As well known to those skilled in the art, oxide cathodes or impregnated cathodes have been typically used as the thermal electron emitting cathodes for the Braun tubes. However, the above typical cathodes, that is, the oxide and impregnated cathodes, are problematic in that they not only cause a retardation of the instantaneous operation, but they also have a short life span. In order to rectify the above problem, metal alloy cathodes substituting for the typical cathodes have been actively studied recently. The metal alloy cathodes may be formed of either various alloys or single metals. It has been noted that the cathodes of Ir—Ce alloy or of Ir—La alloy have an excellent operational performance in various aspects in comparison with both the above oxide cathodes and the impregnated cathodes. However, the metal alloy cathodes have not been commercialized as they have to be produced through an arc melting process. This is because one metal having a lower melting point is melted earlier than the other metal having a higher melting point in the arc melting process, thereby being vaporized while the metals are alloyed.

In a typical color picture tube, three electron guns are installed to produce, control, focus, deflect, and converge three electron beams. Each electron gun installed in the color picture tube comprises an oxide cathode 1, a basic metal 2 and a heater 3 as shown in FIG. 1.

The oxide cathode 1 used for emitting electrons is bonded to the top of the basic metal 2 which will be heated by the heater 3. The heater 3 is placed inside the basic metal 2. The heater 3 generates heat when a current flows in the heater 3.

The above basic metal 2 has the following designing conditions. That is, the above basic metal 2 is required to have a short enough length to not only increase the electrical resistivity, but also to cause the cathode to operate rapidly. Additionally, the basic metal 2 has a sufficient high slenderness ratio to improve its thermal emission. The metal 2 also has a high temperature strength sufficient enough to maintain its specified configuration at the high cathode operating temperatures. The basic metal 2 further has a specified structure suitable to allow the oxide cathode 1 to emit a sufficient amount of electrons for a long time even when the metal 2 is coated with alkali earth oxides.

In an effort to achieve the above designing conditions, the basic metal 2 may be produced as follows. That is, both a high melting point metal having an excellent heat resistance, such as tungsten W or molybdenum Mo, and a small amount of zirconium Zr acting as an activator on the electron emitting oxides are added to the basic ingredient, nickel Ni. However, using the metal produced by the above process as the basic metal 2 results in the generation of intermediate layers between the basic metal 2 and the oxide cathode 1, thereby separating the oxide cathode 1 from the metal 2 while either producing or practically using the color picture tubes.

In order to rectify the above problem, a process in which an oxide layer formed of Ni particles is mechanically fixed between the basic metal 2 and the oxide cathode 1 has been proposed. However, this process is also problematic in that the configuration of the Ni particles may be deformed while the electron gun operates, thereby causing the fixed state of the oxide cathode on the basic metal to become unstable and separating the oxide cathode from the basic metal.

SUMMARY OF THE INVENTION

It is, therefore, an object of the present invention to provide a direct heating cathode for electron guns in which the above problems can be overcome and which achieves a high current density, extends the expected life span and simplifies the cathode producing process.

It is another object of the present invention to provide a process for producing the above direct heating cathode.

In order to accomplish the above object, the present invention provides a process for producing a direct heating cathode for electron tubes comprising the steps of mixing powdered iridium (Ir) as a basic ingredient with powdered cerium (Ce) as a subsidiary ingredient at a given mixing ratio into a powdered metal mixture; applying a mechanical impact to the powdered metal mixture through high energy ball milling, thereby mechanically alloying the powdered metal mixture into alloy powder; compressing the alloy powder with a given pressure, thereby forming an alloy pellet; removing residual gases from the pellet; and testing an electron emitting performance of the pellet.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

The present invention not only provides an electron emitting direct heating cathode of metal alloy for electron tubes, it also provides a process for producing the above direct heating cathode. In order produce the above direct heating cathode, two types of powdered metals are mixed with each other into a powdered metal mixture in the 1st step. That is, 85–95 wt % of powdered iridium (Ir) as the basic ingredient is mixed with 5–15 wt % of powdered cerium (Ce) as the subsidiary ingredient at a given mixing ratio, thereby forming the powdered metal mixture.

Thereafter, the powdered iridium and the powdered cerium in the above mixture are mechanically alloyed into an alloy in the 2nd step. In this mechanical alloying step, either high energy ball milling or low energy ball milling may be used to mechanically alloy the powdered metals.

In the low energy ball milling process, the ball mill is operated at a relatively lower rotating speed of 90–120 rpm for 100–1000 hours. Stearic acid is used as a process controlling agent. Additionally, the weight ratio of the balls to the powdered metal mixture is 50:1–150:1.

Figure 2:
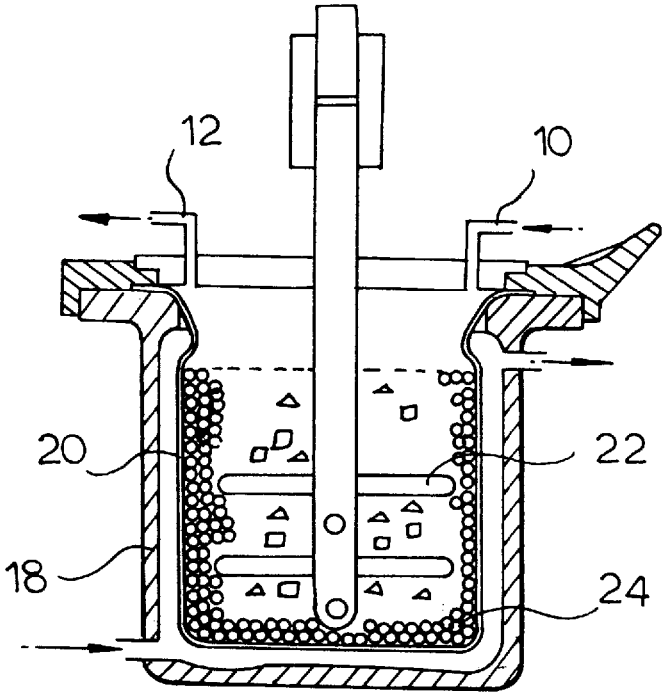
FIG. 2 is a sectional view of a mechanical alloying device for producing a direct heating cathode in accordance with the present invention.

An example of the ball mills used in the high energy ball milling according to the invention is shown in FIG. 2. As shown in the drawing, the powdered metal mixture coming out of the 1st step is put into a pulverizing cylinder 20 prior to rotating the rods 22 placed in the cylinder 20. As a result of the rotating motion of the rods 22, a plurality of balls 24 contained in the cylinder 20 collide with each other while cascading and rotating in the cylinder 20. Therefore, the powdered mixture of Ir and Ce in the cylinder 20 is applied with a large mechanical impact by the balls 24, thereby being formed into alloy powder. In the above state, the temperature inside the cylinder 20 rises due to the impact of the balls 24.

The rising temperature inside the cylinder 20 is reduced by the cooling water flowing in a cooling chamber defined between the cylinder 20 and a cooling case 18 surrounding the cylinder 20. In this case, the cooling water flows into the chamber at the bottom side of the case 18 and flows out of the chamber at the top side of the case 18. The flowing direction of the cooling water is shown by the arrows in FIG. 2.

In the high energy ball milling using the above ball mill, the ball mill is operated at a relatively higher rotating speed of 300–700 rpm for 10–50 hours. In the same manner as that described for the low energy ball milling, stearic acid is used as the process controlling agent. In addition, the weight ratio of the balls to the powdered metal mixture is 50:1–150:1. Of course, it should be understood that the mechanical alloying step of this invention may be performed using either a vibration mill or a shaker mill instead of the above ball mill with an attrition.

The above alloying step is followed by a compressing step. In the above compressing step, the alloy powder coming out of the mechanical alloying step is applied with a pressure of 3–8 ton per unit area, thereby being formed into a pellet 30 of FIG. 3.

After forming the above pellet 30, the pellet 30 is heated to 400°–700° C. in a vacuum so as to remove residual gases such as $H_2O$, $O_2$ and $(OH)_2$ from the pellet 30.

Thereafter, the electron emitting performance of the resulting pellet is tested at 1000°–1500° C. in a vacuum.

In the above process, a heat treating step may be selectively performed after the residual gas removing step. The above heat treating step is performed to uniform the quality of the pellet's alloy. In the above heat treating step, the pellet is heated at 1300°–1800° C. for 1–500 hours. The above heat treating step is preferably performed in a vacuum.

Figure 1:
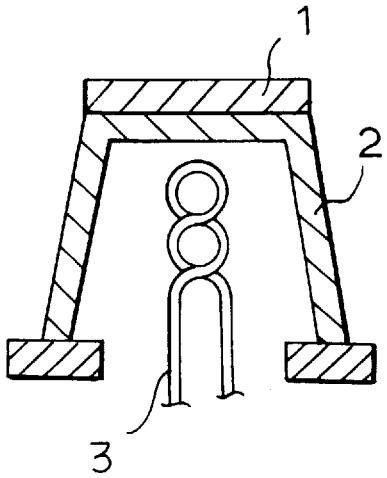
FIG.1 (PRIOR ART)
FIG. 1 is a sectional view schematically showing the construction of a typical oxide cathode for electron tubes.
Figure 3:
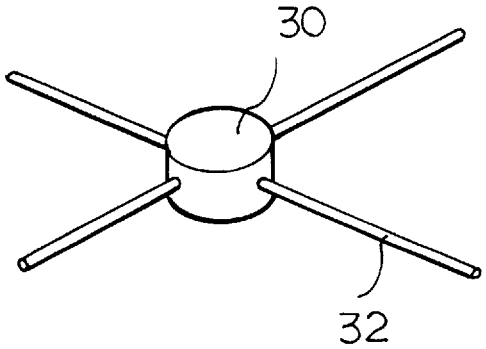
FIG. 3 is a schematic perspective view showing the construction of the direct heating cathode of the present invention.

FIG. 3 is a schematic perspective view showing the construction of a direct heating cathode produced using the pellet of the above process. As shown in the drawing, the direct heating cathode of this invention has a plurality of tungsten wires 32 which evolve heat when a current flows in them. The tungsten wires 32 horizontally penetrate the pellet 30 which will emit the electrons. In the operation of the above cathode, the tungsten wires 32 evolve heat when the current flows in them. Therefore, the pellet 30 receives the heat of the wires 32 and thereby emits the electrons.

In the present invention, the direct heating cathode for electron tubes comprises 85–95 wt % of Ir, Pt or Au as the basic ingredient and 5–15 wt % of Ce, La or Pr as the subsidiary ingredient.

The alloy, $Ir_5Ce$, produced by the above process has a melting point of 1900° C. The above alloy, $Ir_5Ce$, also has an excellent operational performance at high temperatures and has a low work function, thereby having improved electron emitting performance in comparison with any typical electron emitting material. Particularly with the excellent operational performance at high temperatures of the alloy, it is possible to extend the expected life span of the direct heating cathodes.

The mechanical alloying step of alloying the powdered Ir and Ce mixture into the alloy powder is a solid phase reaction step. The direct heating cathode produced by the above mechanical alloying step has a current density of about 7–10 A/cm$^2$ at 1400° C. The above current density of this direct heating cathode is increased by about 2–5 A/cm$^2$ than that of any typical direct heating cathodes produced by the typical arc melting process. With the above higher current density, the direct heating cathode of this invention has an excellent electron emitting performance.

Additionally, the cathode producing process of this invention includes neither the K-decomposition step nor the aging step, thereby being simplified. Both the K-decomposition step and the aging step are the necessary steps of the typical cathode producing process. In the K-decomposition step, the cathode is heated in a vacuum, thus to decompose carbonates of the cathode into oxides. In the aging step, the cathode is kept at a constant temperature for a given time after the K-decomposition step in order to improve its electron emitting performance. Another advantage of the present invention is resided in that the present invention uses the powdered metals, thereby being suitable to produce the direct heating cathodes for electron tubes in large quantities.

Having described specific preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A process for producing a direct heating cathode for electron tubes comprising the steps of:

mixing powdered iridium (Ir) as a basic ingredient with powdered cerium (Ce) as a subsidiary ingredient at a given mixing ratio into a powdered metal mixture;

applying a mechanical impact to said powdered metal mixture through high energy ball milling, thereby mechanically alloying the powdered metal mixture into alloy powder;

compressing said alloy powder with a given pressure, thereby forming an alloy pellet;

removing residual gases from said pellet; and testing an electron emitting performance of said pellet.

2. The process according to claim 1, wherein the mechanical alloying step of forming the alloy powder is performed using either a vibration mill or a shaker mill.

3. The process according to claim 1, wherein the mechanical alloying step of forming the alloy powder is performed through low energy ball milling, said low energy ball milling being performed under the conditions of a ball mill rotating speed of 90–120 rpm, a processing time of 100–1000 hours, using stearic acid as a process controlling agent and a weight ratio of the balls to the powdered metal mixture of 50:1–150:1.

4. The process according to claim 1, wherein the mechanical alloying step of forming the alloy powder is performed through high energy ball milling, said high energy ball milling being performed under the conditions of a ball mill rotating speed of 300–700 rpm, a processing time of 10–50 hours, using stearic acid as a process controlling agent and a weight ratio of the balls to the powdered metal mixture of 50:1–150:1.

5. The process according to claim 1, wherein the residual gas removing step also includes a heat treating step of heating said pellet to 1300°–1800° C. for 1–500 hours under either inert gas or the vacuum condition, thereby uniforming the quality of the pellet's alloy.

6. A direct heating cathode for electron tubes produced by a process comprising the steps of:

mixing 85–95 wt % of a powdered basic ingredient comprising Ir, Pt or Au with 5–15 wt % of a powdered subsidiary ingredient comprising Ce, La or Pr at a given mixing ratio into a powdered metal mixture;

applying a mechanical impact to said powdered metal mixture through high energy ball milling, thereby mechanically alloying the powdered metal mixture into alloy powder;

compressing said alloy powder with a given pressure, thereby forming an alloy pellet;

removing residual gases from said pellet; and testing an electron emitting performance of said pellet.

* * * * *